US006763875B2

(12) United States Patent
Gronlund et al.

(10) Patent No.: US 6,763,875 B2
(45) Date of Patent: Jul. 20, 2004

(54) REDUCED VISIBILITY INSECT SCREEN

(75) Inventors: Patrick J. Gronlund, Star Prairie Township, WI (US); Rodney K. Williams, Stacy, MN (US); Russell J. Pylkki, St. Paul, MN (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 10/068,069

(22) Filed: Feb. 6, 2002

(65) Prior Publication Data

US 2003/0145960 A1 Aug. 7, 2003

(51) Int. Cl.[7] ..... E06B 9/52

(52) U.S. Cl. ..... 160/371

(58) Field of Search ..... 160/371; 245/8

(56) References Cited

U.S. PATENT DOCUMENTS

| | | | | |
|---|---|---|---|---|
| 4,002,188 | A | 1/1977 | Hanks | |
| 4,412,255 | A | 10/1983 | Kuhlman et al. | |
| 4,587,997 | A | 5/1986 | Brooks | |
| 4,980,227 | A | 12/1990 | Sekiguchi et al. | |
| 5,012,041 | A * | 4/1991 | Sims et al. | 174/35 MS |
| 5,139,076 | A | 8/1992 | Langdon | |
| 6,109,331 | A * | 8/2000 | Story, Jr. | 160/371 |
| 6,164,361 | A | 12/2000 | Meyer | |
| 6,331,223 | B1 | 12/2001 | Wylie et al. | |
| 6,341,444 | B1 | 1/2002 | Cina et al. | |
| 2001/0042348 | A1 | 11/2001 | Lundahl | |
| 2002/0134709 | A1 * | 9/2002 | Riddle | 209/238 |

FOREIGN PATENT DOCUMENTS

| | | |
|---|---|---|
| DE | 200 20 267 U1 | 5/2001 |
| GB | 2 178 765 A | 2/1987 |
| JP | 60-28547 | 2/1985 |
| JP | 9-195646 | 7/1997 |
| JP | 2000-27568 | 1/2000 |
| NL | 9500121 | 11/1995 |

OTHER PUBLICATIONS

Screen Technology Group, Bolting Cloth, Jun. 28, 1998.*
"Aluminum Insect Screen Cloth", http://www.wire–cloth.com/aluminum–screens.htm, 2 pgs. (Last Revised Jul. 11, 2002).
"Aluminum Insect Screening", http://www.phifer.com/alumsc.html, 1 pg. (Printed Jul. 14, 2002).
"Basic Wire Cloth and Wire Mesh Weaving Methods", http://www.wire–cloth.com/weaves.htm 1 pg. (Last Revised Jul. 11, 2002).
"Bronze Insect Screens", http://www.wire–clothcom/bronze–screens.htm, 1 pg. (Last Revised Jul. 11, 2002).
"Comparative Gauge/Decimal Wire Diameters", http://www.wire–cloth.com/reference/gauge.htm, 3 pgs. (Last Revised Jan. 3, 2002).
"Detailed Product Specifications for Woven Wire Cloth and Wire Mesh are Illustrated in the Various Product Group Tables", http://www.wire–cloth.com/products.htm, 2 pgs. (Last Revised Jul. 11, 2002).
"Fiberglass Insect Screening", http://www.phifer.com/fiber.htm, 1 pg. (Printed Jul. 28, 2002).
"Fibreglass Insect Screening", http://www.rjreid.co.nz/screen.htm, 1 pg. (Printed Jul. 28, 2002).
"Fine Mesh Wire Cloth", http://www.wire–cloth.com/fine–mesh.htm, 2 pgs.(Last Revised Jul. 11, 2002).

(List continued on next page.)

*Primary Examiner*—Blair M. Johnson
(74) *Attorney, Agent, or Firm*—Womble Carlyle Sandridge & Rice, PLLC

(57) ABSTRACT

An insect screen that includes a rigid frame defining a frame perimeter and a metal screen located within the rigid frame perimeter. The metal screen has a plurality of metal elements with a dark mat surface. The metal elements have a width of about 0.001 inch to about 0.0015 inch. The insect screen has a reduced visibility such that it appears nearly invisible or transparent.

16 Claims, 2 Drawing Sheets

OTHER PUBLICATIONS

"Galvanized Steel Insect Mesh", http://www.wire–cloth.com/galvanized–screens.htm, 1 pg. (Last Revised Jul. 11, 2002).
"Insect Screening Mesh", http://www.lockwire.co.uk/Insect.htm 1 pg. (Printed Jul. 28, 2002).
"Light Transmitting Fabric", http://www.rjreid.co.nz/ltfab.htm, 1 pg. (Printed Jul. 28, 2002).
"Market Grade Wire Cloth", http://www.wire–cloth.com/market–cloth.htm, 2 pgs. (Last Revised Jul. 11, 2002).
"Mill Grade Wire Cloth", http://www.wire–cloth.com/mill–cloth.htm, 2 pgs. (Last Revised Jul. 11, 2002).
"Specialty Screen Products", http://www.hanoverwire.com/hscreen.htm, 2 pgs. (Printed Jul. 14, 2002).
"Stainless Steel Insect Screens", http://www.wire–cloth.com/stainless–screens.htm, 1 pg. (Last Revised Jul. 11, 2002).
"Tensile Bolting Cloth", http://www.wire–cloth.com/bolting–cloth.htm, 2 pgs. (Last Revised Jul. 11, 2002).
"Technical Information [High Transparency Wire Mesh]", http://www.twpinc.com/high_trans.html, 2 pgs. (Printed Jul. 28, 2002).
"Technical Information [Insect Screen]", http://www.twpinc.com/insect.html, 2 pgs. (Printed Jul. 28, 2002).
"Technical Information [Welded Stainless Mesh]," *TWP Inc.*, 2831 Tenth Street, Berkeley, CA 94710, http://www.twpinc.com/welded.html, 2 pgs. (Printed Feb. 4, 2003).
"Toyota Wire Cloth," *Toyota Tsusho America, Inc.*, http://www.ttairwirecloth.com/screen–printing, 2 pgs. (Last modified Jul. 16, 2002).
"Toyota Wire Cloth—Top Quality Screen Printing Cloth," *Toyota Tsusho America, Inc.*, http://www.ttaiwirecloth.com/screen–print–cloth, 3 pgs. (Last modified Jul. 2, 2002).

* cited by examiner

FIG. 1
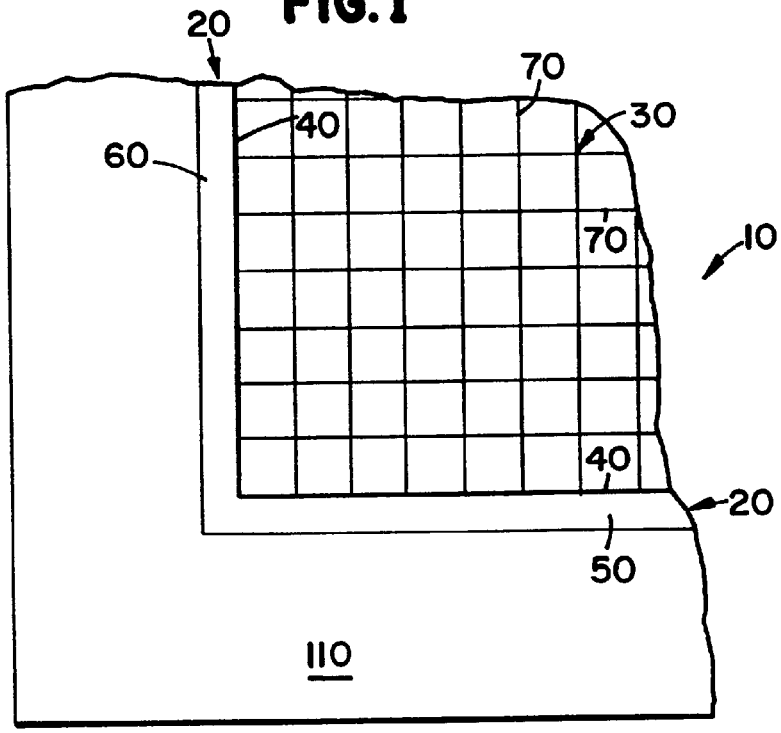
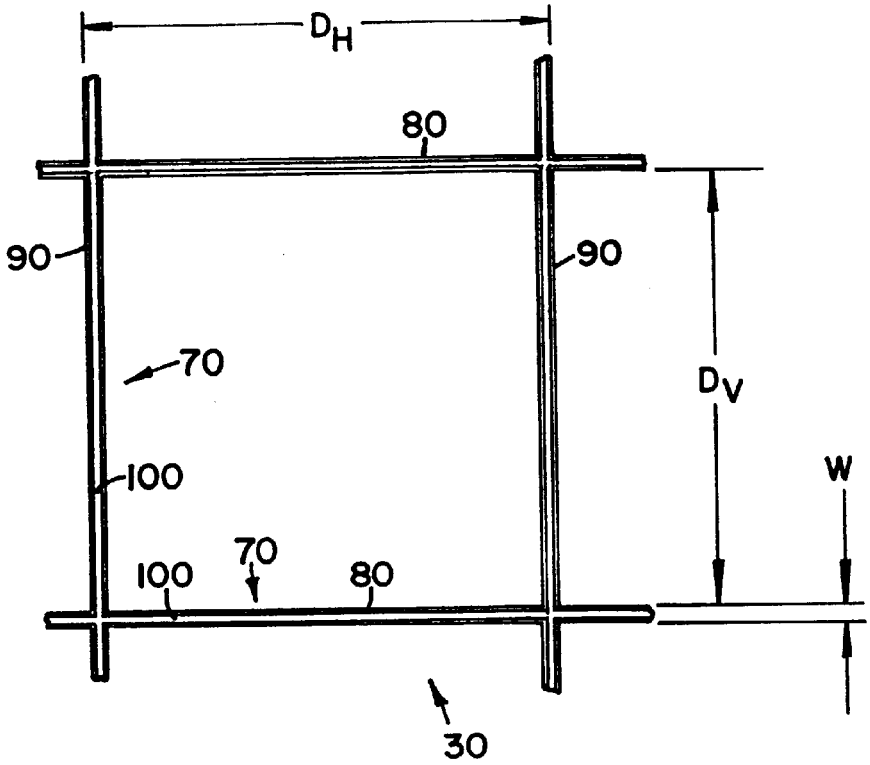
FIG. 2

REDUCED VISIBILITY INSECT SCREEN

BACKGROUND OF THE INVENTION

The invention generally relates to insect screens for fenestration units such as, for example, window screens, that are less visible.

A wide variety of window screens are available in the prior art. For many years, most window screens were made of metal, which would eventually rust. Additionally, the individual strands or elements of such screens were relatively wide leading to significant attenuation and distortion of light passing there through. These characteristics were undesirable in that they distorted the view available through windows or doors treated with such material.

SUMMARY OF THE INVENTION

In accordance with the present invention, there is provided an insect screen that includes a rigid frame defining a frame perimeter and a metal screen located within the rigid frame perimeter. The metal screen has a plurality of metal elements having a width from about 0.001 inch to about 0.0015 inch and a dark mat surface, which reduces the visibility of the screen.

Also in accordance with the present invention, there is provided a method that includes providing an insect screen having a rigid frame defining a frame perimeter and a metal screen located within the rigid frame perimeter. The metal screen has a plurality of metal elements that have a width of about 0.001 inch to about 0.0015 inch and a dark mat surface, which reduces the visibility of the screen. The method further includes providing a fenestration unit and placing the insect screen in the fenestration unit.

BRIEF DESCRIPTION OF THE DRAWINGS

FIG. 1 is a fragmentary view of an insect screen in accordance with the invention.

FIG. 2 is a fragmentary view of a portion of the insect screen shown in FIG. 1.

DETAILED DESCRIPTION

Figure 3:
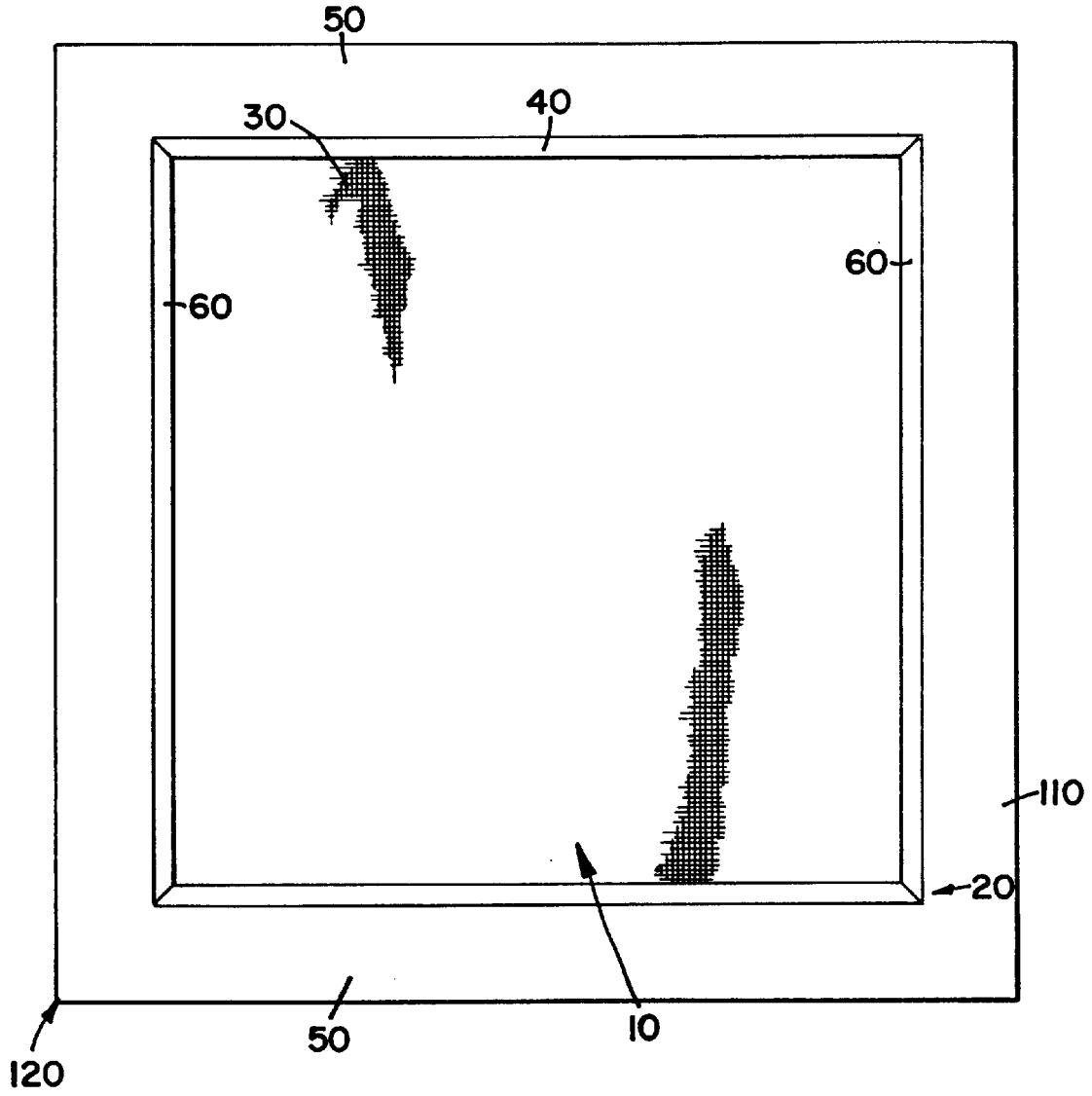
FIG. 3 is a prospective view of the insect screen shown in FIG. 1 located in a fenestration unit.

FIG. 1 is a fragmentary drawing of a portion of an insect screen 10 in accordance with the present invention. The insect screen 10 consists of a rigid frame 20 defining a rigid frame perimeter 40. A metal screen 30 is located within the rigid frame perimeter 40. The rigid frame 20 supports the metal screen 30 on all sides of the metal screen 30 at the rigid frame perimeter 40.

FIG. 3 is a prospective view of the insect screen shown in FIG. 1 located in a fenestration unit 120. The rigid frame 20 may include two pairs of opposed rigid frame members. A first pair of opposed rigid frame members 50 can be oriented along a horizontal rigid frame axis. A second pair of opposed rigid frame members 60 can be oriented along a vertical rigid frame axis. The four rigid frame members 50, 60 can generally form a square or rectangle shape. However, the rigid frame may be any shape.

FIG. 2 is a fragmentary view of a portion of the insect screen shown in FIG. 1. The metal screen 30 includes a plurality of metal elements 70. The metal elements 70 may have a width or diameter W of about 0.001 inch to about 0.0015 inch, or about 0.0012 inch. Each metal element 70 has a length to span the distance between opposed rigid frame members 50, 60. Each metal element 70 may be connected to the opposed rigid frame members 50, 60 in any conventional manner.

The plurality of metal elements 70 can include a plurality of horizontal metal elements 80 and a plurality of vertical elements 90. The horizontal metal elements 80 may be spaced apart from each other a distance Dv of about 0.015 inch to about 0.020 inch or about 0.018 inch. The vertical metal elements 90 may also be spaced apart from each other a distance DH of about 0.015 inch to about 0.020 inch or 0.018 inch.

The plurality of horizontal and vertical metal elements 80, 90 can be constructed and arranged to form a mesh where a horizontal metal element intersects a vertical metal element perpendicularly. The intersecting horizontal and vertical metal elements 80, 90 may be woven together. Alternatively, the intersecting horizontal and vertical metal elements 80, 90 may be fused together.

The metal screen 30 may be formed from a metal that has a low coefficient of thermal expansion such as, for example, stainless steel. A low coefficient of thermal expansion reduces thermal expansion or contraction due to temperature changes and thus reduces distortion of the metal elements 70 and aids in reducing the visibility of the insect screen 10. The metal screen 30 may be formed from a metal that has a high tensile strength, such as, for example, stainless steel, to reduce breaks in the metal screen 30.

The surface 100 of the metal elements 70 is a dark non-reflective, dull or mat finish disposed thereon. A dark non-reflective, dull or mat finish is defined herein to mean a finish that absorbs a sufficient amount of light such that the metal screen 30 appears less obtrusive than a metal screen 30 without such finish. The dark non-reflective or mat finish may be any color that absorbs a substantial amount of light, such as, for example, a black color. The dark non-reflective or mat finish can be applied to the metal element surface 100 by any means available such as, for example, anodizing, liquid coating, ion deposition, plasma deposition, vapor deposition, and the like. Liquid coating may be, for example, paint, ink, and the like.

The insect screen 10 can be used in conjunction with a fenestration unit 110. The fenestration unit 110 may be any arrangement of components constructed and arranged to interact with an opening in a surface such as, for example, a building wall, roof, ceiling, floor, and the like. The surface may be an interior, exterior or interior and exterior surface. The fenestration unit 110 may be a window (i.e. an opening in a wall or building for admission of light and air that may be closed by casements or sashes containing transparent, translucent or opaque material and may be capable of being opened or closed), such as, for example, a picture window, a bay window, a double-hung window, a skylight, egress window, and the like. The fenestration unit 110 may be a doorway or door (i.e. a swinging or sliding barrier by which an entry may be closed and opened), such as, for example, a front door, a patio door, a French door, a side door, a back door, a storm door, a garage door, a sliding door, and the like.

The insect screen 10 may be placed in and form a part of the fenestration unit. The insect screen 10 may be permanently affixed to the fenestration components or the insect screen 10 may be able to be removed from the fenestration components. The insect screen 10 may be placed on the interior, exterior or both the interior and exterior surface of the fenestration unit 110. The insect screen 30 may be placed within the fenestration unit 110.

We claim:

1. An insect screen comprising:

(a) a rigid frame defining a frame perimeter; and (b) a metal screen located within the rigid frame perimeter, the metal screen having a plurality of metal elements with a dark mat surface finish; the metal elements having a width of about 0.001 inch to about 0.0015 inch.

2. The insect screen of claim 1, wherein the width is about 0.0012 inch.

3. The insect screen of claim 1, wherein the finish is black.

4. The insect screen of claim 1, wherein the plurality of metal elements are spaced apart from each other a distance of about 0.015 inch to about 0.020 inch.

5. The insect screen of claim 1, wherein the plurality of metal elements include a plurality of horizontal metal elements, the horizontal metal elements being spaced a distance of about 0.015 inch to about 0.020 inch, and a plurality of vertical metal elements, the vertical metal elements being spaced a distance of about 0.015 inch to about 0.020 inch.

6. The insect screen of claim 5, wherein the horizontal metal elements and the vertical metal elements are spaced apart from each other a distance of about 0.01 inch.

7. The insect screen of claim 1, wherein the metal elements are stainless steel.

8. A method comprising:

(a) providing an insect screen, the insect screen including:
a rigid frame defining a frame perimeter; and
a metal screen located within the rigid frame perimeter, the metal screen having a plurality of metal elements with a dark mat surface, the metal elements having a width of about 0.001 inch to about 0.0015 inch;

(b) providing a fenestration unit; and (c) placing the insect screen in the fenestration unit.

9. The method of claim 8, wherein the width of the metal elements is about 0.0012 inch.

10. The method of claim 8, wherein the dark mat surface is a black surface.

11. The method of claim 8, wherein the plurality of metal elements are spaced apart from each other a distance of about 0.015 inch to about 0.020 inch.

12. The method of claim 8, wherein the plurality of metal elements include a plurality of horizontal metal elements, the horizontal metal elements being spaced a distance of about 0.015 inch to about 0.020 inch, and a plurality of vertical metal elements the vertical metal elements being spaced a distance of about 0.015 inch to about 0.020 inch.

13. The method of claim 12, wherein the horizontal metal elements and the vertical metal elements are spaced apart from each other a distance of about 0.018 inch.

14. The method of claim 8, wherein the metal elements are stainless steel.

15. The method of claim 8, wherein the fenestration unit is a window.

16. The method of claim 8, wherein the fenestration unit is a door.

* * * * *